US009126416B2

(12) United States Patent
Murphy et al.

(10) Patent No.: US 9,126,416 B2
(45) Date of Patent: Sep. 8, 2015

(54) FLUID CARTRIDGE

(75) Inventors: Bryan Murphy, Park West Dublin (IE); William Jon Rittgers, Celbridge Kildare (IE); Coilin Hegarty, Dublin (IE); Eduardo Macias, Clonee Meath (IE); Odhran Hendley, Bray Kildare (IE); Michael Mulloy, Dublin (IE)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/368,510

(22) PCT Filed: Jan. 23, 2012

(86) PCT No.: PCT/US2012/022194

§ 371 (c)(1),
(2), (4) Date: Jun. 25, 2014

(87) PCT Pub. No.: WO2013/112125

PCT Pub. Date: Aug. 1, 2013

(65) Prior Publication Data

US 2015/0035915 A1 Feb. 5, 2015

(51) Int. Cl.
*B41J 2/175* (2006.01)

(52) U.S. Cl.
CPC ..... *B41J 2/17523* (2013.01); *B41J 2/17513* (2013.01)

(58) Field of Classification Search
USPC ..... 347/85, 86, 87
See application file for complete search history.

(56) References Cited

U.S. PATENT DOCUMENTS

| | | | | |
|---|---|---|---|---|
| 5,489,932 | A * | 2/1996 | Ceschin et al. | 347/87 |
| 5,560,720 | A | 10/1996 | Suzuki et al. | |
| 5,949,458 | A | 9/1999 | Studholme | |
| 6,145,972 | A * | 11/2000 | Udagawa et al. | 347/86 |
| 6,238,042 | B1 | 5/2001 | Kobayashi et al. | |
| 6,264,316 | B1 * | 7/2001 | Chino | 347/86 |
| 6,454,399 | B2 * | 9/2002 | Ujita et al. | 347/86 |
| 6,474,798 | B1 | 11/2002 | Shinada et al. | |
| 6,955,423 | B2 | 10/2005 | Rodriquez Mojica et al. | |
| 7,380,926 | B2 | 6/2008 | Studer et al. | |
| 7,413,298 | B1 | 8/2008 | Jones | |
| 7,631,954 | B2 | 12/2009 | Conway et al. | |
| 7,735,983 | B2 | 6/2010 | Pearson et al. | |
| 2003/0052951 | A1 | 3/2003 | Ujita | |
| 2009/0109268 | A1 | 4/2009 | Yildirim et al. | |

FOREIGN PATENT DOCUMENTS

| | | |
|---|---|---|
| CN | 1396057 | 2/2003 |
| JP | 2006102996 | 4/2006 |
| JP | 2006116861 | 5/2006 |

* cited by examiner

*Primary Examiner* — Ahn T. N. Vo
(74) *Attorney, Agent, or Firm* — Steven R. Ormiston

(57) ABSTRACT

In one example, a fluid cartridge for an inkjet type liquid dispensing device includes a housing having a chamber therein for holding a liquid, a vent through which air may enter the chamber, and an outlet through which liquid may pass from the chamber out of the housing. A capillary material is disposed in the chamber between the vent and the outlet so that, when the capillary material is sufficiently depleted of liquid, the capillary material forms an airway from the vent to the outlet. The outlet configured to cause an abrupt break in a liquid connection in the outlet as air enters the outlet through the capillary material.

10 Claims, 7 Drawing Sheets

FLUID CARTRIDGE

BACKGROUND

Inkjet printers utilize a printhead that includes an array of orifices through which ink is ejected on to paper or other print substrate. One or more printheads may be mounted on a movable carriage that traverses back and forth across the width of the paper feeding through the printer, or the printhead(s) may remain stationary during printing operations, as in a page wide array of printheads. In some inkjet printers, the printhead is part of a discrete assembly to which ink is supplied from a separate, detachable ink cartridge in which the ink is held in a block of foam or other capillary material. For printhead assemblies that utilize these types of detachable ink cartridges, the printed image can fade as a cartridge runs out of ink.

DRAWINGS

The same part numbers designate the same or similar parts throughout the figures.

DESCRIPTION

Figure 1:
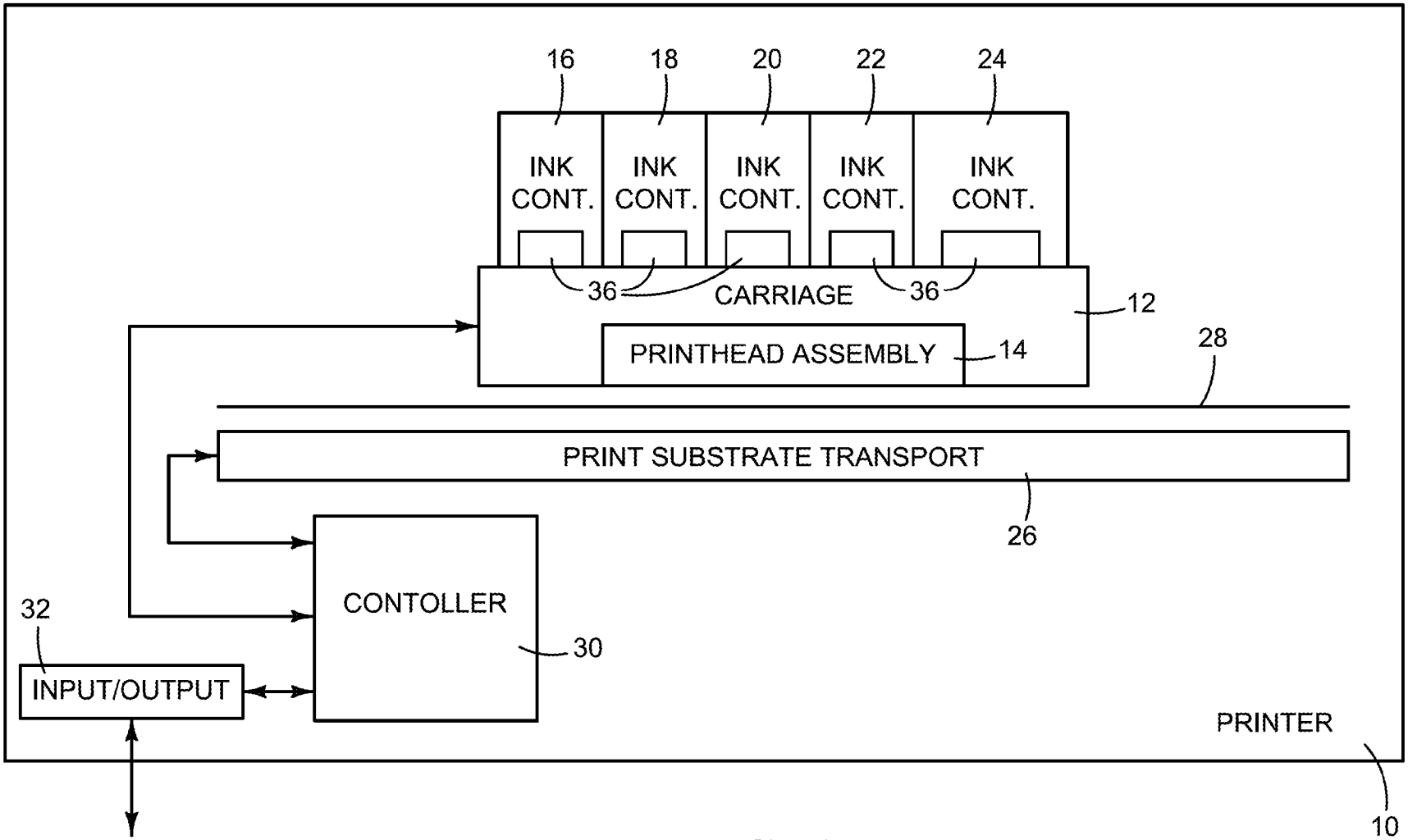
FIG. 1 is a block diagram illustrating one embodiment of an inkjet printer in which examples of the new ink cartridge may be implemented.

A new ink cartridge has been developed to help create a sharp transition from a fully printed page to a nearly blank page as the cartridge runs out of ink, minimizing fade and improving the accuracy of a printer's end of life messaging. Conventional foam based ink cartridges can cause poor image quality as the cartridge runs out of ink and the foam releases the remaining ink during printing. It has been discovered that introducing a free ink chamber into the ink flow path between the foam (or other capillary material) and the outlet wick allows an abrupt break to be made in the flow of ink from the cartridge to the printhead assembly, allowing a sharp transition between a complete printed page without any fade to an incomplete page with a near total absence of ink. Examples of the new fluid cartridge are described below with reference to an ink cartridge for an inkjet printer. However, examples of the new cartridge are not limited to ink cartridges, inkjet printers or inkjet printing. Examples of the new fluid cartridge might also be implemented in other types of fluid dispensers. The examples shown in the figures and described below, therefore, illustrate but do not limit the invention, which is defined in the Claims following this Description.

In one example of a new ink cartridge, the outlet from the ink chamber is formed by a conduit that includes a first part in contact with and compressing the capillary material in the ink chamber, a second part holding the outlet wick, and a third, unobstructed part between the first part and the second part for holding free ink. The capillary material provides an airway from the cartridge vent to the outlet conduit. When the capillary material is saturated with ink, little if any air will reach the outlet conduit. As the ink supply is depleted, the level of ink saturation in the capillary material decreases until, when the saturation level falls below a threshold, air will move into the outlet conduit. When enough air has entered the free ink chamber, the liquid capillary connection that makes the fluidic link between the printhead assembly and the capillary media is broken and the ink ejection chambers can no longer refill with ink and, thus, no ink will be ejected onto the print substrate.

In one version, the open first part of the outlet conduit forms a compression seal directly with the capillary material. In this version, the relationship between the bubble pressure and the saturation of the capillary material will determine the threshold at which air begins to enter the outlet conduit. In another version, the inlet to the first part of the conduit is covered with a filter that has a bubble pressure greater than the bubble pressure of the capillary material when the capillary material is substantially depleted of ink. The filter allows more ink to be extracted from the capillary material before air begins to enter the free ink chamber in the outlet conduit. In another version, the opening into the first part of the conduit is covered by a wick that has a capillary pressure greater than the capillary pressure of the capillary material. The wick will remain saturated with ink after the capillary material is depleted of ink, thus delaying the entry of air into the free ink chamber until substantially all of the ink is extracted from the capillary material.

Figure 2:
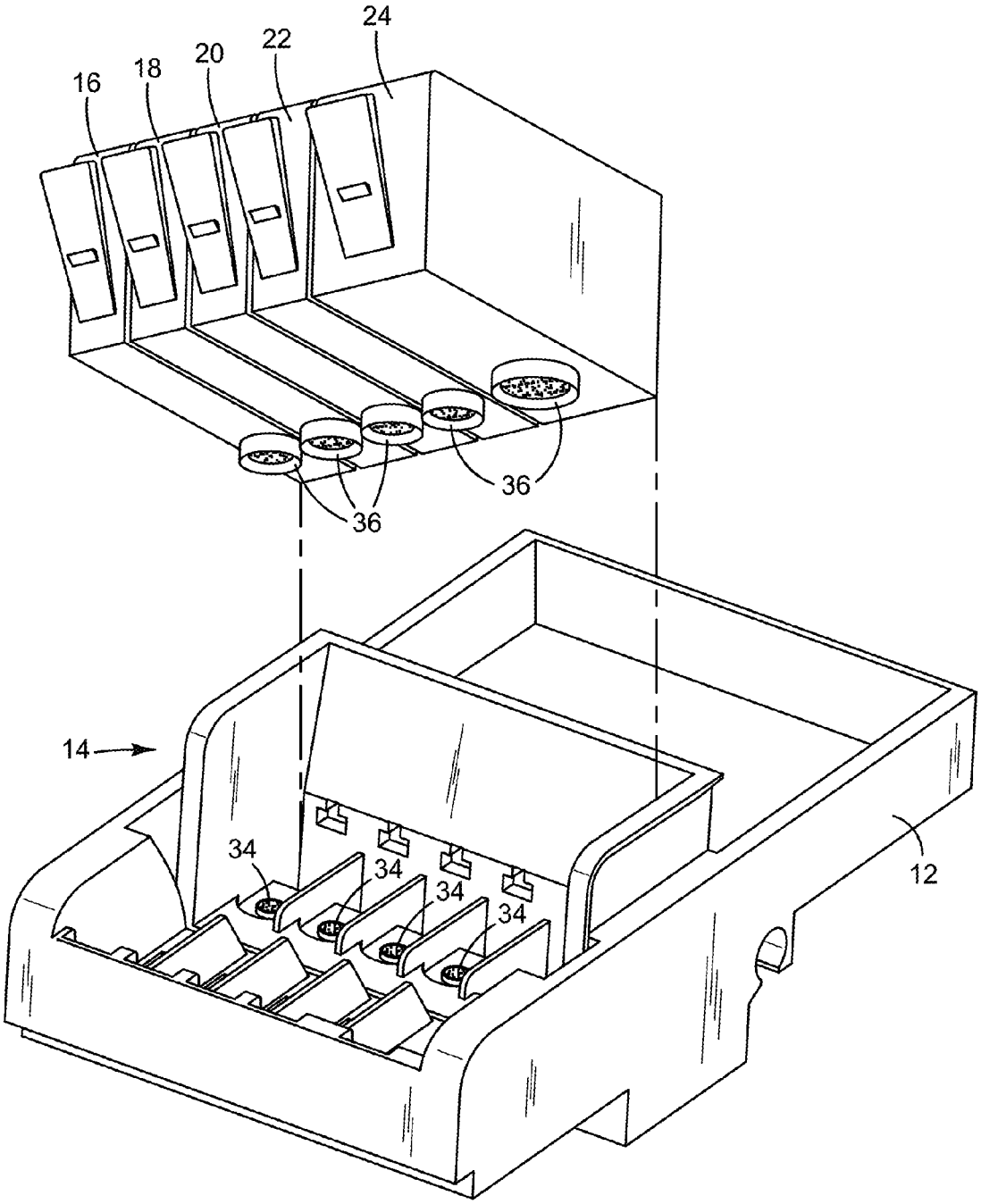
FIGS. 2 and 3 are perspective views of a carriage and printhead assembly, such as might be used in the printer of FIG. 1, with the ink cartridges exploded out from the carriage to show the inlets to the printhead assembly and the outlets from the ink cartridges.
Figure 3:
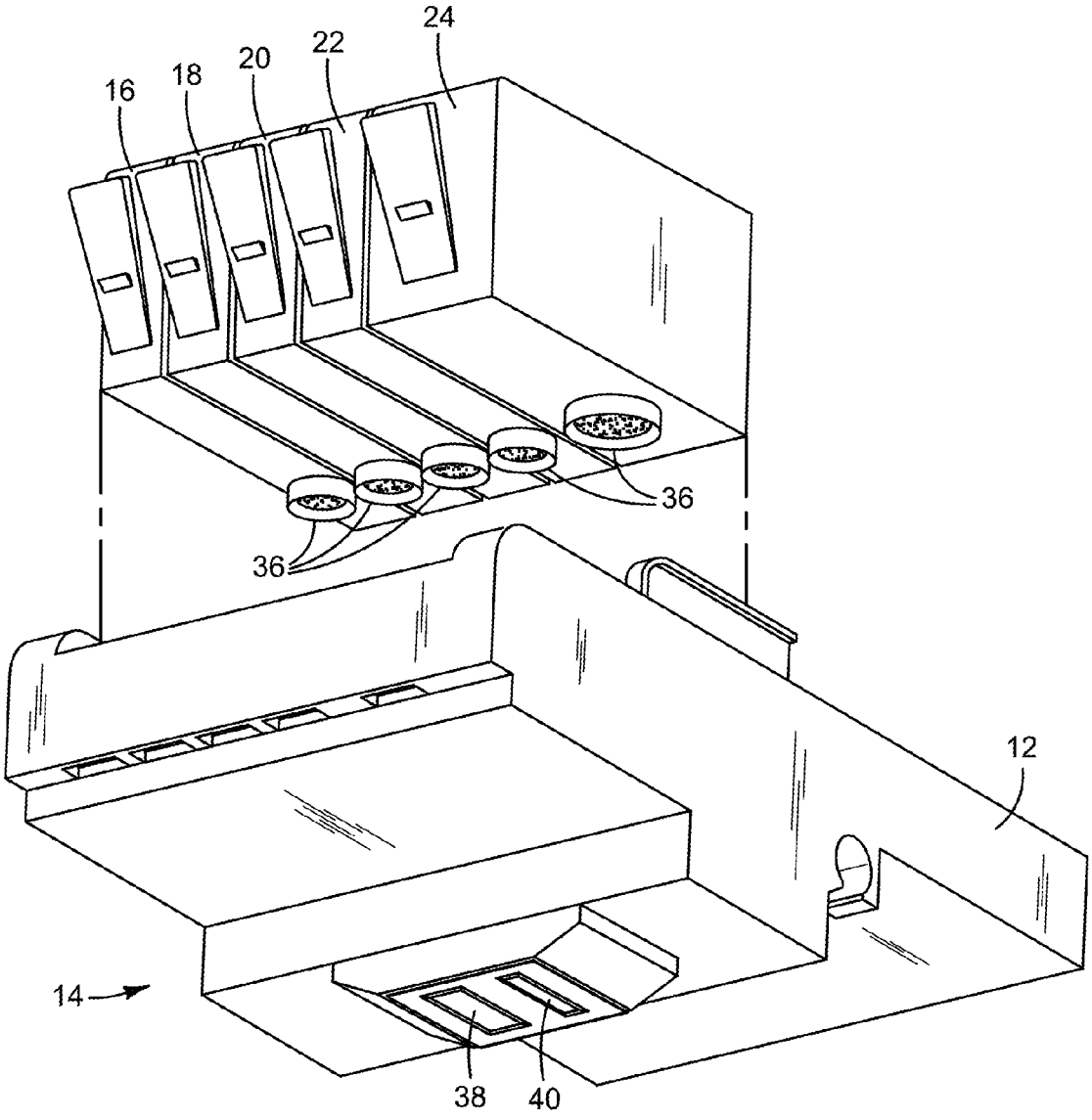
Figure 4:
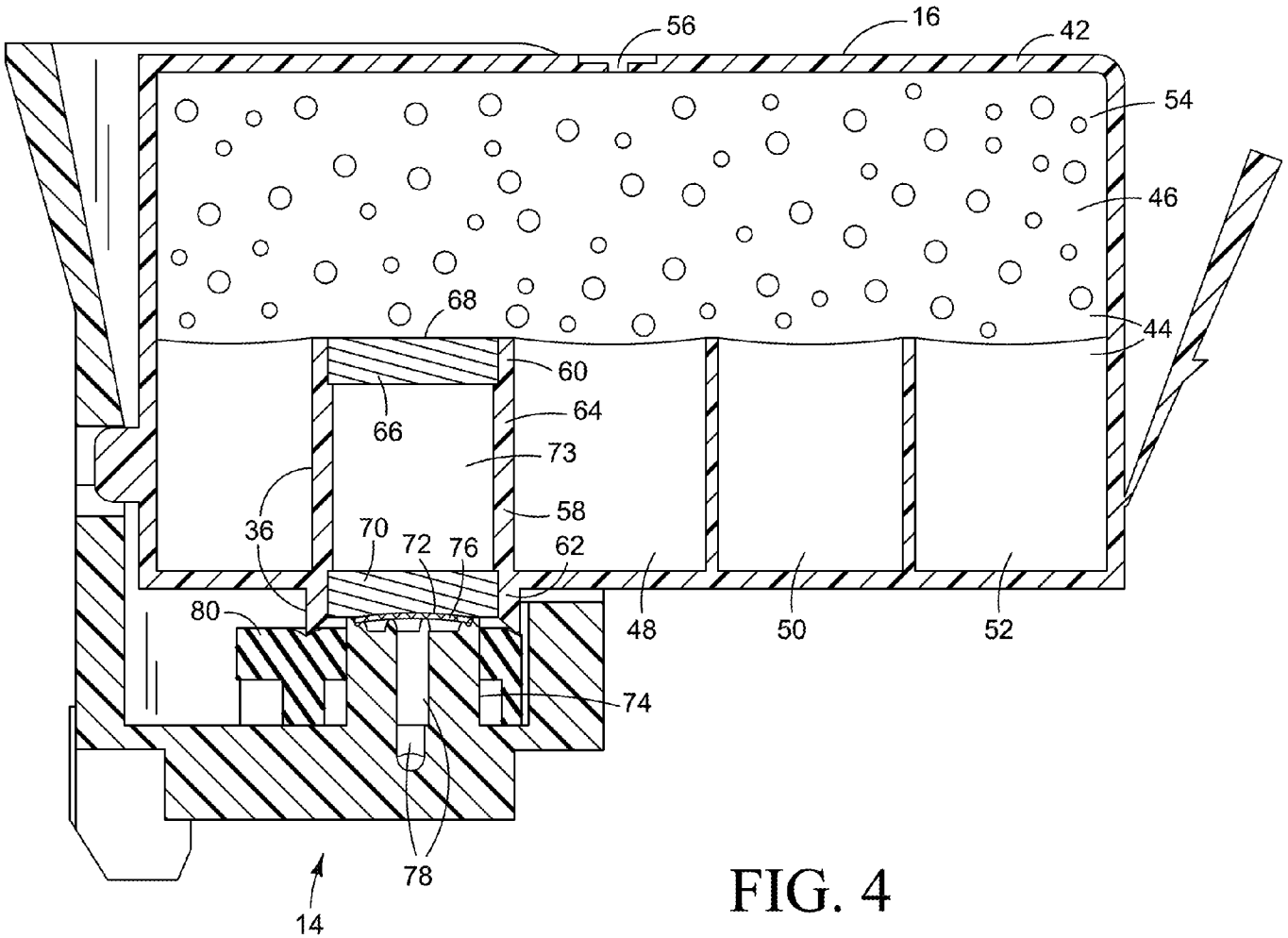
FIGS. 4 and 5 are detail views illustrating one example for the ink cartridges in FIGS. 1-3.
Figure 5:
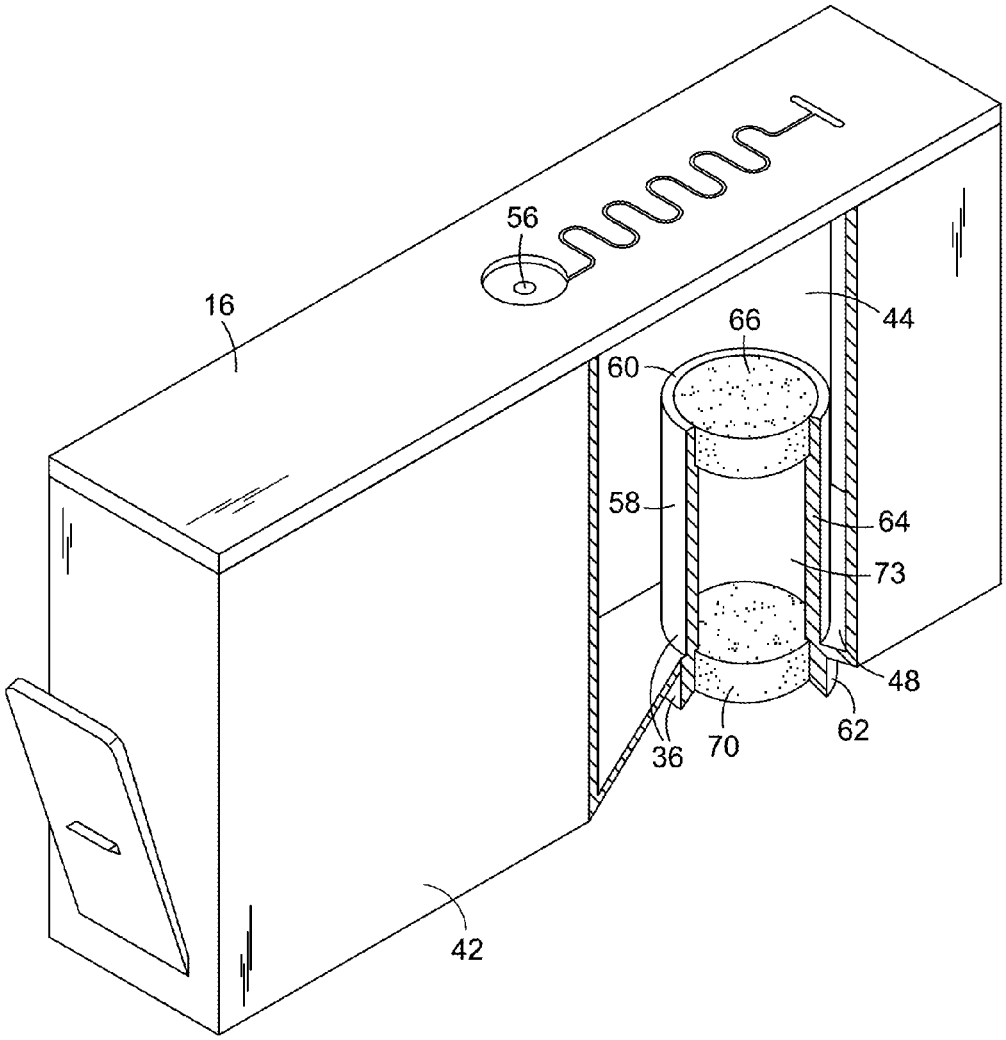

FIG. 1 is a block diagram illustrating an inkjet printer 10 in which examples of the new fluid cartridge may be implemented. FIGS. 2 and 3 illustrate a carriage 12 and printhead assembly 14 in printer 10. Ink cartridges 16, 18, 20, 22, 24 are exploded out from carriage 12 in FIGS. 2 and 3 to show the ink inlets to printhead assembly 14 and the ink outlets from ink cartridges 16-24. FIGS. 4 and 5 are detail views illustrating one example for an ink cartridge 16-24 in FIGS. 1-3.

Referring first to FIG. 1, printer 10 includes a carriage 12 carrying a printhead assembly 14 and detachable ink cartridges 16, 18, 20, 22, and 24 that supply ink to printhead assembly 14 through outlets 36. Examples of outlets 36 are described in detail below with reference to FIGS. 4-7. Printhead assembly 14 includes one or more printheads through which ink from one or more cartridges 16-24 is ejected. A print substrate transport mechanism 26 advances a sheet of paper or other print substrate 28 past carriage 12 and printhead assembly 14. An electronic controller 30 is operatively connected to carriage 12, printhead assembly 14 and substrate transport 26. Controller 30 may communicate with external devices through an input/output device 32, for example to receive print data for inkjet imaging. Controller 30 controls the movement of carriage 12 (for a scanning carriage printer 10) and substrate transport 26. Controller 30 is electrically connected to each printhead in printhead assembly 14 to selectively energize ink ejection elements for ejecting ink drops on to substrate 28. By coordinating the relative position of carriage 12 with substrate 28 and the ejection of ink drops, controller 30 produces the desired image on substrate 28.

Referring now also to FIGS. 2 and 3, printhead assembly 14 includes ink inlets 34 (FIG. 2) for receiving ink from a corresponding ink outlet 36 on each ink cartridge 16-24. In the example shown, printhead assembly 14 includes two printheads 38 and 40 (FIG. 3). Ink from color ink cartridges 16-22, for example, is ejected from printhead 38 and ink from a black ink cartridge 24 is ejected from printhead 40.

FIGS. 4 and 5 are detail views illustrating one example configuration for ink cartridge 16. This same configuration could be used for any of cartridges 16-24 in FIGS. 1-3. Referring to FIGS. 4 and 5, ink cartridge 16 includes a housing 42 that forms an interior chamber 44 for holding ink. In the example shown, chamber 44 is made up of a larger, primary chamber 46 and smaller, secondary chambers 48, 50 and 52. Ink in primary chamber 46 is held in foam or other suitable capillary material 54 that occupies substantially the entire volume of primary chamber 46. Capillary material 54 is omitted from FIG. 5 to more clearly show other features of cartridge 16. Ink in secondary chambers 48-52 is held as free ink. Chamber 44 is vented to the atmosphere through an opening 56 in the top of housing 42.

Ink flows from chamber 44 into printhead assembly 14 through outlet 36. Outlet 36 is formed by a conduit 58 having a first, interior part 60 through which ink enters conduit 58, a second, exterior part 62 through which ink leaves conduit 58, and a third, central part 64 extending between interior part 60 and exterior part 62. Conduit interior part 60 contacts and compresses capillary material 54 as shown in FIG. 4 to help move ink from capillary material 54 into conduit 58. In the example shown in FIGS. 4 and 5, a wick 66 located in conduit interior part 60 forms the fluidic interface 68 between ink chamber 44 (through capillary material 54) and outlet 36. A "wick" as used in this document means a capillary material having a higher capillarity than capillary material 54 in ink chamber 44.

Another wick 70 located in conduit exterior part 62 forms the fluidic interface 72 between ink cartridge 16 (through outlet 36) and printhead assembly 14. The second, central part 64 of conduit 58 is unobstructed between first wick 66 and second wick 70 to form a free ink chamber 73. This configuration for outlet 36 creates a "capillary cascade" in which ink flows from a lower capillary media 54 to a higher capillary media, upper wick 66, to a still higher capillary media, lower wick 70. Thus, it is desirable for this cascading capillary flow that upper wick 66 have a lower bubble pressure than lower wick 70.

When cartridge 16 is installed in printhead assembly 14, as shown in FIG. 4, second wick 70 engages an inlet structure 74 on printhead assembly 14 at an interface 72, for example through a filter 76, to establish an operative fluidic connection between ink cartridge 16 and printhead assembly 14. Second, lower wick 70 and filter 76 form a surface-to-surface contact fluid transfer mechanism. Air will not pass through this interface unless the bubble pressure of wick 70 or filter 76 is exceeded. An ink channel 78 in printhead assembly 14 downstream from filter 76 carries ink to a printhead 38 or 40 (FIG. 3). Inlet structure 74 is sometimes referred to as an inlet "tower" because it usually extends out from the surrounding structure. Cartridge outlet 36 fits around inlet tower 74 and seals against an elastomeric gasket or other suitable seal 80 to help prevent air from entering at fluidic interface 72.

Figure 6:
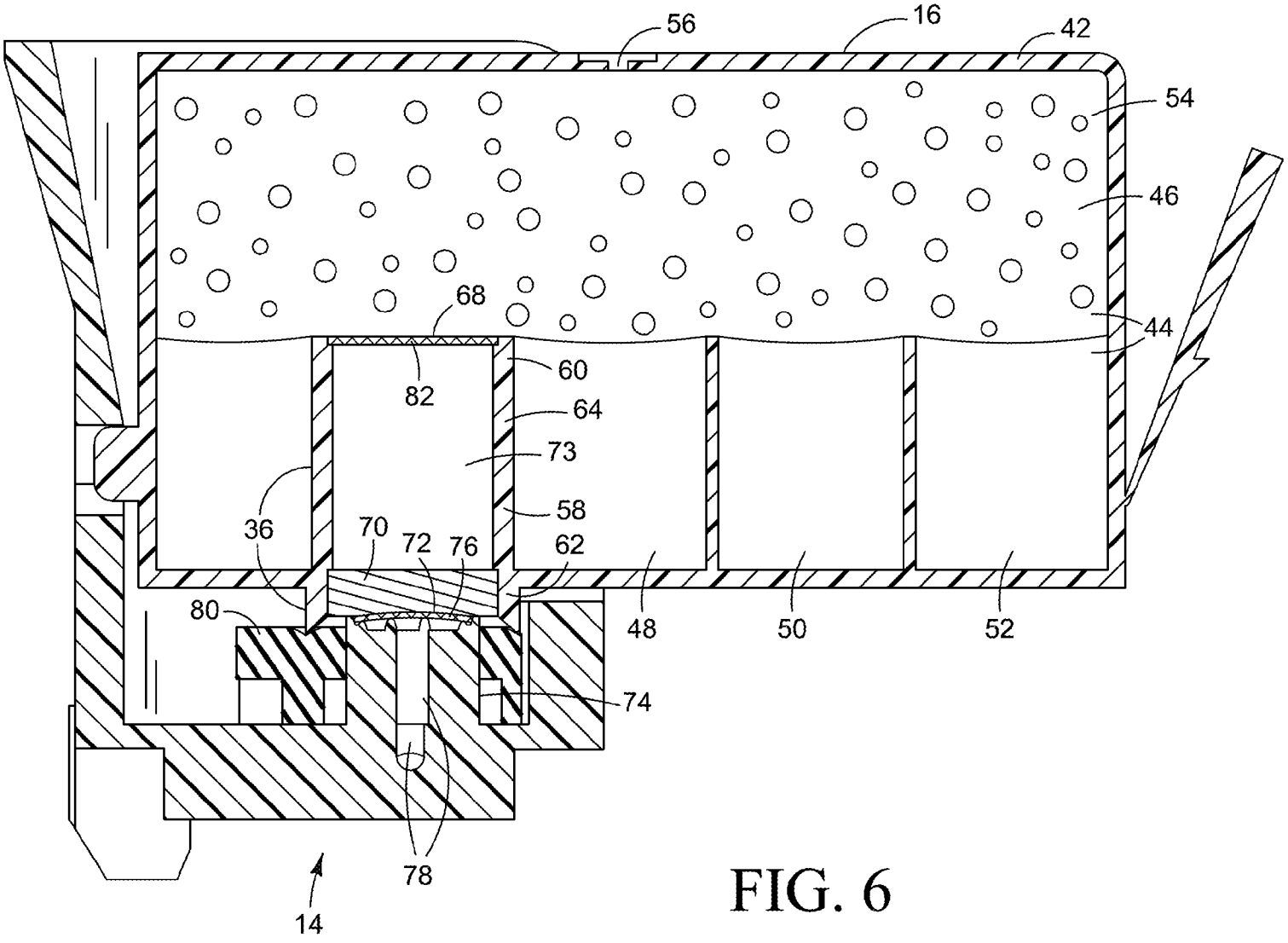
FIGS. 6 and 7 are detail views illustrating other examples for the ink cartridges of FIGS. 1-3.
Figure 7:
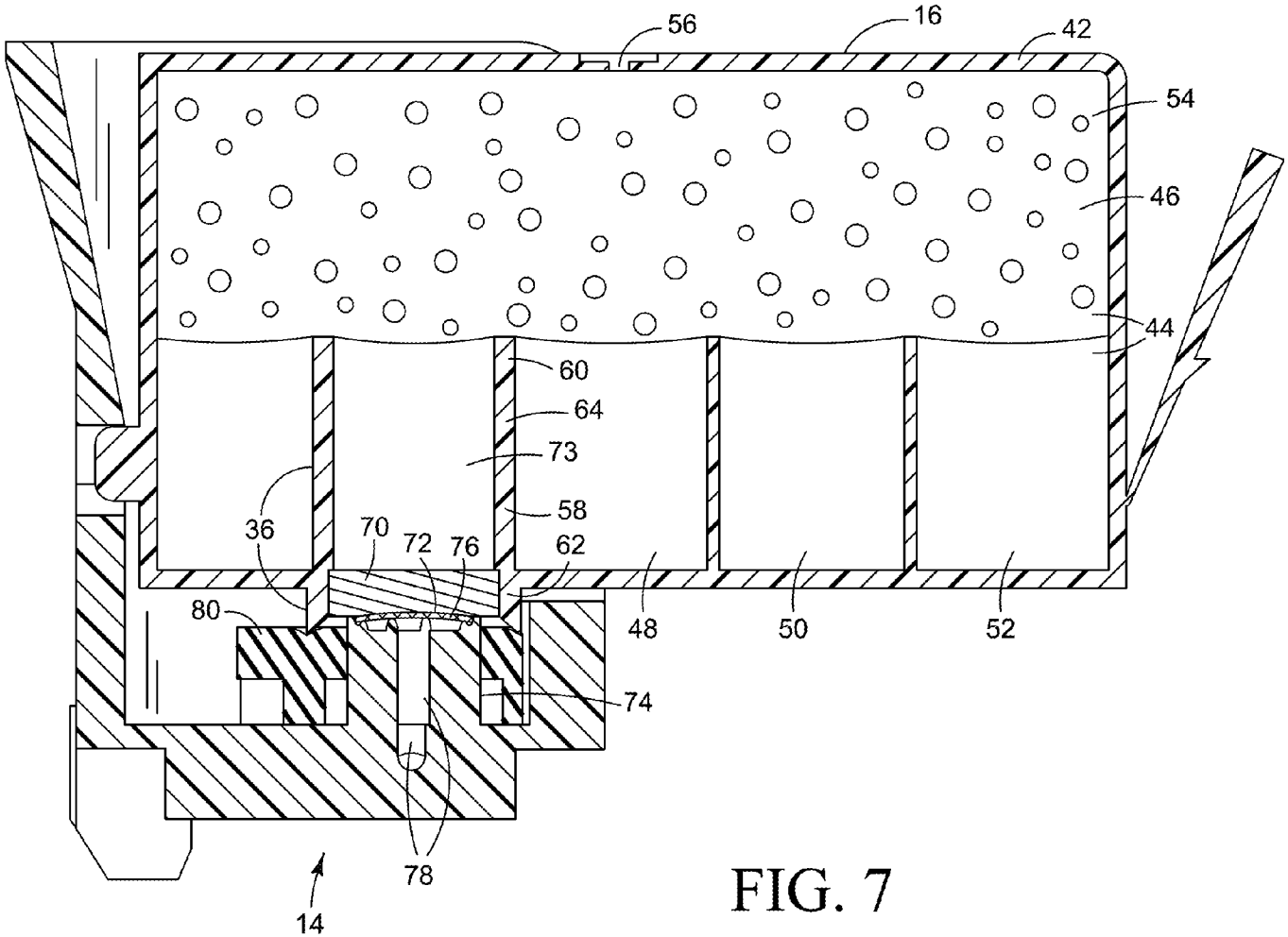

In another example of cartridge 16 shown in FIG. 6, a filter 82 covers the opening into outlet conduit 58. In another example of cartridge 16 shown in FIG. 7, the opening into outlet conduit 58 is exposed directly to capillary material 54.

In each of the examples shown in FIGS. 4-7, when capillary material 54 is saturated with ink, virtually no air enters conduit 58 through capillary material 54 and a liquid capillary connection is maintained between cartridge 16 and printhead assembly 14. As the ink in capillary material 54 is depleted, air will enter outlet conduit 58. When enough air has entered free ink chamber 73, the capillary connection and thus the fluidic link between the printhead assembly and the capillary media is broken and the ink ejection chambers can no longer refill with ink. Accordingly, no ink will be ejected onto the print substrate. In the example shown in FIGS. 4 and 5, printing will continue to draw ink from free ink chamber 73 into the printheads while wick 66 remains saturated with ink. As the ink in wick 66 is also depleted, air will eventually pass through wick 66 into free ink chamber 73 to break the fluidic link so that the ink ejection chambers in the printheads can no longer refill with ink. In the example shown in FIG. 6, printing will continue to draw ink from free ink chamber 73 until the bubble pressure of filter 82 is exceeded and air passes through filter 82 into free ink chamber 73 to break the fluidic link to printhead assembly 14. In the example shown in FIG. 7, printing will continue to draw ink from free ink chamber 73 until the bubble pressure of media 54 exposed directly to the opening into conduit 58 is exceeded and air passes into free ink chamber 73 to break the fluidic link to printhead assembly 14.

It has been observed for the example shown in FIGS. 4 and 5 that continuous printing through the transition from a fully printed page to a nearly blank page allows fading as seen with conventional cartridges. However, it has also been observed that if printing is paused during the transition from full ink to no ink, for example when fading is first detected, then an abrupt break is made in the flow of ink from the cartridge to the printhead assembly, allowing a sharp transition with no further fading. The duration of the pause for breaking the fluidic connection depends on the volume of ink in free ink chamber 73 and the rate at which air can enter chamber 73 to displace the ink. The rate at which air enters free ink chamber 73 may be controlled by the bubble pressure and permeability of wick 66 and the volume of ink in chamber 73 may be controlled by the geometry of conduit 58. The pause in printing appears to cause a final break in the fluidic link. While air displacement allows the break in the fluidic link, it is not yet known with certainty if air displacement is the only factor in completely breaking of the link. The final break in the fluidic link during a pause in printing may also be affected by excessive backpressure generated during continuous printing. The pause in printing may allow whatever ink remains linking capillary media 54 to lower wick 70 to be drawn back up toward ink chamber 44 under increased backpressure, breaking the remaining ink link.

As noted at the beginning of this Description, the examples shown in the figures and described above illustrate but do not limit the invention. Other examples are possible. Therefore, the foregoing description should not be construed to limit the scope of the invention, which is defined in the following claims.

What is claimed is:

1. An ink cartridge for an inkjet printer comprising:
- a chamber;
- a vent through which air may enter the chamber;
- a capillary material in the chamber for holding ink;
- a conduit through which ink may flow from the chamber to a print head assembly, the conduit having:
  - a first part through which ink may enter the conduit, the first part of the conduit in contact with and compressing the capillary material;
  - a second part downstream from the first part through which ink may leave the conduit; and
  - a third, unobstructed part between the first part and the second part for holding ink; and
- a first wick covering an outlet from the second part of the conduit.

2. The cartridge of claim 1, further comprising a second wick in contact with the capillary material and covering an inlet to the first part of the conduit.

3. The cartridge of claim 1, further comprising a filter covering an inlet to the first part of the conduit, the filter having a bubble pressure greater than the capillary pressure of the capillary material.

4. A fluid cartridge for an inkjet type liquid dispensing device comprising:

a housing having a chamber therein for holding a liquid, a vent through which air may enter the chamber, and an outlet through which liquid may pass from the chamber out of the housing;

a capillary material in the chamber and covering the outlet, the capillary material disposed between the vent and the outlet so that, when the capillary material is sufficiently depleted of liquid, the capillary material forms an airway from the vent to the outlet; and the outlet configured to cause an abrupt break in a liquid connection in the outlet as air enters the outlet through the capillary material, wherein the outlet comprises a first wick, the outlet further comprising:

the first wick in contact with the capillary material, a second wick downstream from the first wick, and a free ink chamber between the first wick and the second wick; or a conduit having a first part through which ink may enter the conduit, the first part of the conduit in contact with and compressing the capillary material, a second part downstream from the first part through which ink may leave the conduit, and a third, unobstructed part between the first part and the second part for holding ink downstream from the first part, wherein the first wick covers an outlet from the second part of the conduit.

5. The cartridge of claim 4, wherein the outlet configured to cause the abrupt break in the liquid connection comprises a filter in contact with the capillary material and the free ink chamber, the free ink chamber in fluid communication with the filter.

6. The cartridge of claim 4, wherein the outlet configured to cause the abrupt break in the liquid connection comprises the first wick in contact with the capillary material, the second wick downstream from the first wick, and the free ink chamber between the first wick and the second wick.

7. The cartridge of claim 4, wherein the outlet configured to cause the abrupt break in the liquid connection comprises:

the conduit having:

the first part through which ink may enter the conduit, the first part of the conduit in contact with and compressing the capillary material;

the second part downstream from the first part through which ink may leave the conduit; and the third, unobstructed part between the first part and the second part for holding ink downstream from the first part; and the first wick covering the outlet from the second part of the conduit.

8. The cartridge of claim 7, further comprising a second wick in contact with the capillary material and covering an inlet to the first part of the conduit.

9. The cartridge of claim 7, further comprising a filter covering an inlet to the first part of the conduit, the filter having a bubble pressure greater than the capillary pressure of the compressed capillary material.

10. A fluid cartridge comprising:

a chamber;

a vent through which air may enter the chamber;

a capillary material in the chamber;

a conduit having an inlet in contact with the capillary material and an outlet downstream from the inlet;

a first wick in contact with the capillary material and covering the inlet of the conduit;

a second wick covering an outlet of the conduit; and an unobstructed space in the conduit between the first and second wicks.

* * * * *